US005520561A

United States Patent [19]

Langenohl

[11] Patent Number: 5,520,561

[45] Date of Patent: May 28, 1996

[54] POOL FLOAT AND METHOD OF MAKING SAME

[76] Inventor: James P. Langenohl, 9970 112th St., Franklin, Wis. 53132

[21] Appl. No.: 411,190

[22] Filed: Mar. 27, 1995

[51] Int. Cl.[6] ..... B63B 35/78

[52] U.S. Cl. ..... 441/129; 441/132

[58] Field of Search ..... 441/129–132, 441/40, 43–45; 472/129; 114/345

[56] References Cited

U.S. PATENT DOCUMENTS 1,465,790 8/1923 Ranlett .
1,562,276 11/1925 Assenzio .
2,980,927 4/1961 Waters, Sr. ..... 9/347
3,067,441 12/1962 Dysard et al. ..... 9/347
3,602,930 9/1971 Channon ..... 9/347
5,217,400 6/1993 Creek et al. ..... 441/132

*Primary Examiner*—Sherman Basinger
*Attorney, Agent, or Firm*—Henderson & Sturm

[57] ABSTRACT

A pool float (10) and method of joining a generally rectangular sheet (31) of netting and an elongated generally cylindrical flotation member (20) into the pool float (10) by forming sleeve segments from the sheet of netting (31) and deforming and captively engaging the flotation member (20) in a generally U-shaped configuration within the sleeve segments.

5 Claims, 2 Drawing Sheets

POOL FLOAT AND METHOD OF MAKING SAME

TECHNICAL FIELD

This present invention relates to the field of flotation devices in general, and in particular, to a pool float and method of manufacturing the same.

BACKGROUND ART

As can be seen by reference to the following U.S. Pat. Nos. 3,602,930; 2,980,927; 1,562,276; and 1,465,790; the prior art is replete with myriad and diverse flotation devices having either a circular or generally U-shaped configuration.

While all of the aforementioned prior art constructions are more than adequate for the basic purpose and function for which they have been specifically designed, these patented structures are deficient in a number of respects namely ease of fabrication, ability to accept accessories, and lack of grasping surfaces to facilitate ingress and egress from the float.

As a consequence of the foregoing situation, there has existed a longstanding need among water sport enthusiasts for a new type of a pool float construction that is relatively inexpensive due to its ease of manufacture, practical in that it is designed to accept a plurality of conventional and customized accessories, easy to use by virtue of the presence of numerous hand and finger receiving apertures that give purchase holds to the user; and the provision of such a method is a stated objective of the present invention.

DISCLOSURE OF THE INVENTION

Briefly stated, the pool float that forms the basis of the present invention comprises a flotation unit, a net unit, and a method of joining the flotation unit to the net unit to produce the finished pool float of the invention.

The flotation unit comprises in general, an elongated flotation member fabricated from a generally cylindrical length of buoyant foam material.

As will be explained in greater detail further on in the specification, the net unit comprises a net member fabricated from a generally rectangular sheet of soft nylon netting or the like; wherein, selected corners of the netting are severed by diagonal cuts to form generally triangular panels which are rejoined to the main body of net member in conjunction with folded panels of netting to form a generally accurate sleeve dimensioned to receive the flotation member.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
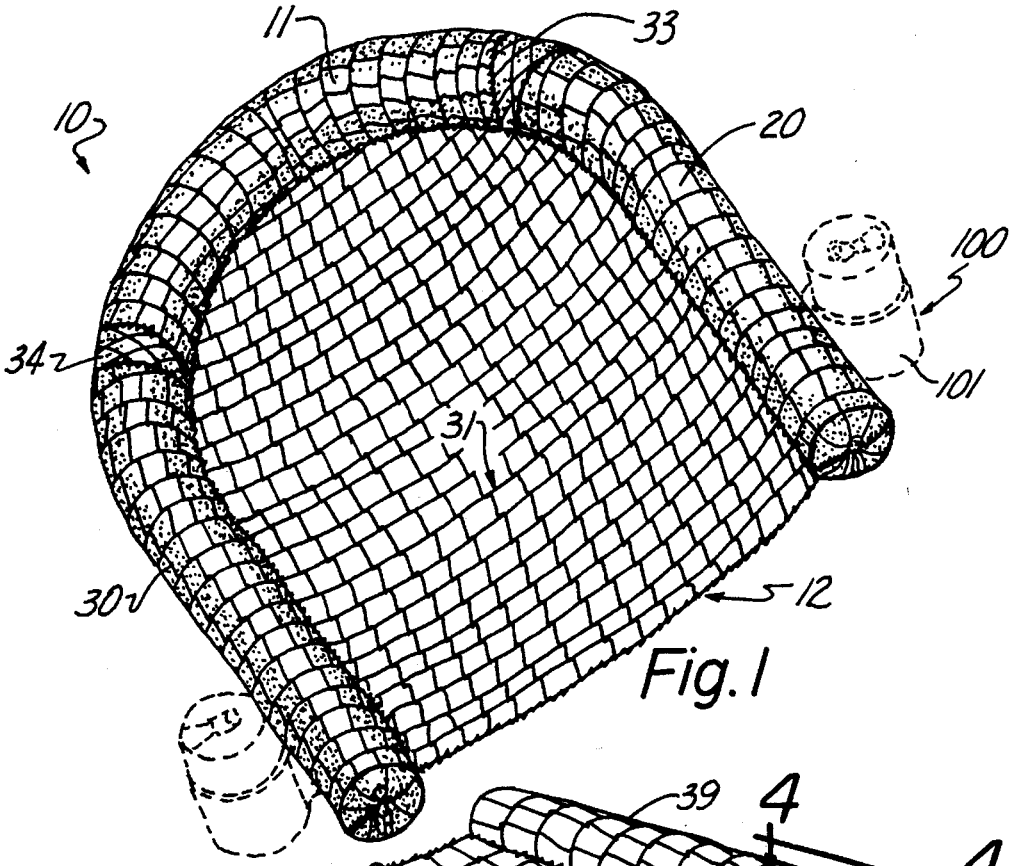
FIG. 1 is a perspective view of the finished pool float that forms the basis of the present invention.

As can be seen by reference to the drawings, and in particular to FIG. 1, the pool float that forms the basis of the present invention is designated generally by the reference numeral (10). The pool float (10) comprises in general, a flotation unit (11) and a net unit (12). These units will now be described in seriatim fashion.

As can best be seen by reference to FIG. 5, the flotation unit (11) comprises in general, a flotation member (20) fabricated from an elongated length of generally, cylindrical buoyant material (21) such as foamed plastic of the like, which is forcibly deformed into a generally U-shaped configuration as will be explained in greater detail further on in the specification.

Figure 2:
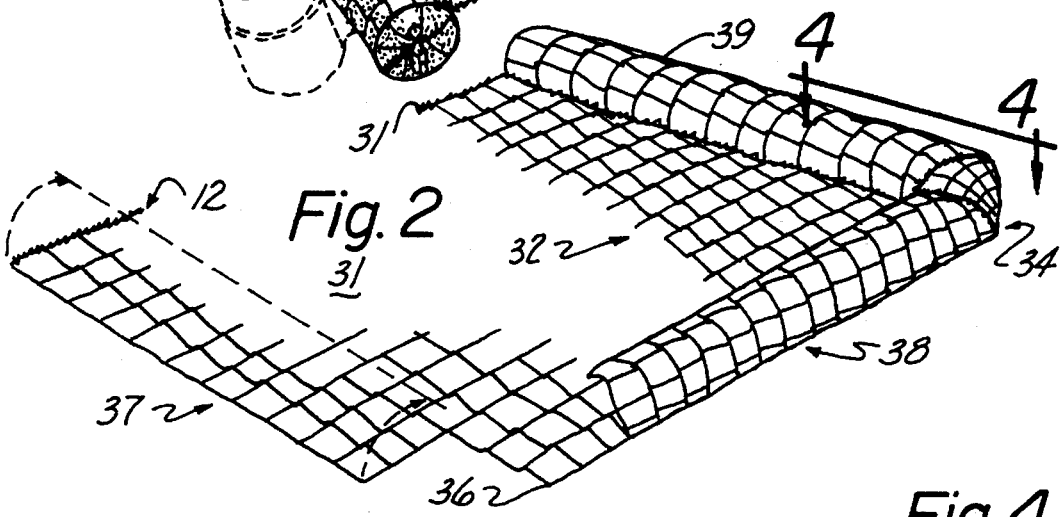
FIG. 2 is a perspective view of the net unit being folded during the manufacturing process.
Figure 3:
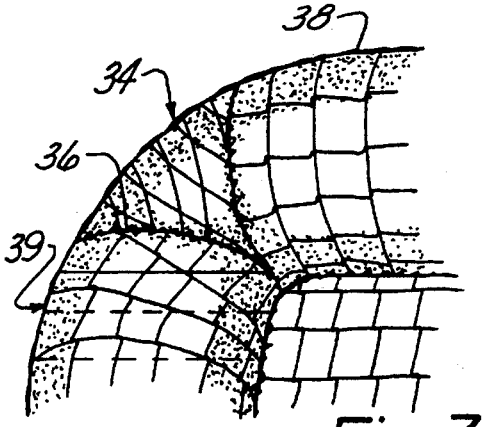
FIG. 3 is an isolated detail view of one corner of the finished pool float.
Figure 4:
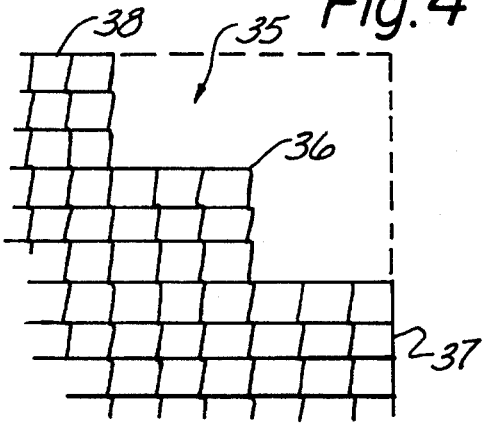
FIG. 4 is an isolated detail view of the severed and folded opposite corner of the net unit.

Turning now to FIGS. 2 and 4, it can be seen that the net unit (12) comprises a net member (30) fabricated from a generally rectangular sheet (31) of relatively soft nylon netting; wherein, adjacent corners (33) (34) of the rectangular sheet (31) have a generally L-shaped portion (35) removed therefrom, to create generally triangular-shaped flaps (36) on each of the adjacent corners (33) (34), whose purpose and function will be explained shortly.

As can best be seen by reference to FIG. 2, the severed L-shaped portions (35) form a plurality of generally rectangular side panels (37) (38) and (39) on three adjacent sides of the main body (32), wherein, the triangular-shaped flaps (36) are disposed intermediate the panels (37) (38) (39).

In the fabrication of the net unit (12) the rectangular panels (37) (38) and (39) are folded onto the main body (32) of the rectangular sheet (31) and the free edges of the panels (37) (38) and (39) are secured, such as by stitching of the like to the main body (32) of the rectangular sheet (31) to form enlarged sleeve segments which are dimensioned to receive the generally cylindrical flotation member (20).

In addition, each of the triangular flaps (36) are secured, such as by stitching or the like, to the edges of both of the adjacent rectangular flaps (38) (39) and (37) (38) as well as the main body (32) of the rectangular sheet (31) such that the sleeve segments rare contiguous around three sides of the net member (30).

Figure 5:
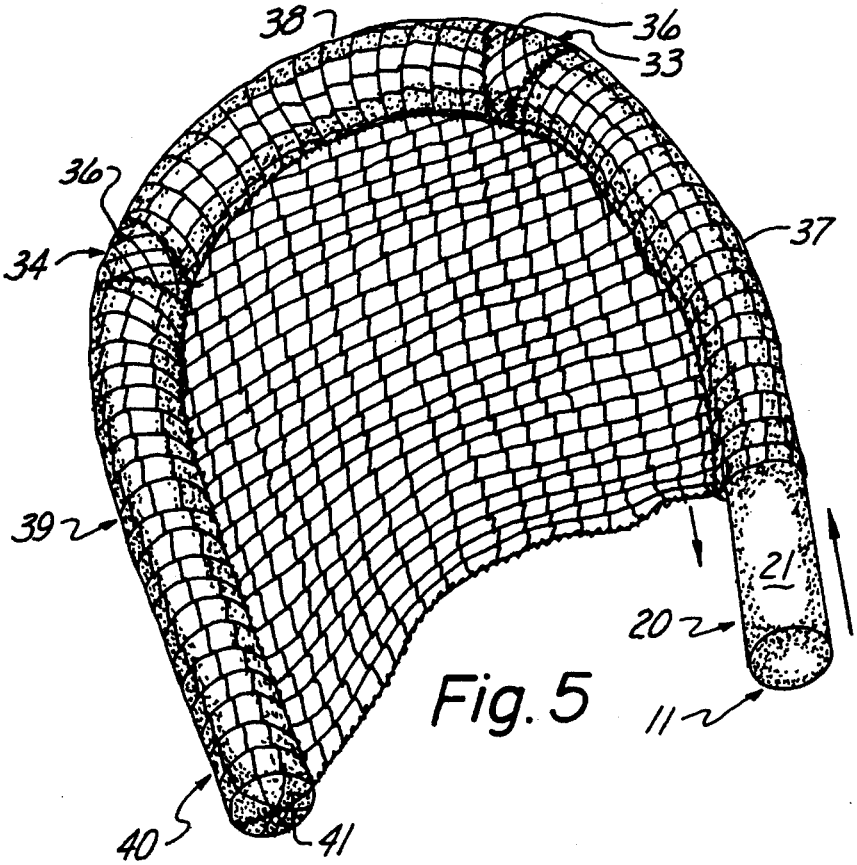
FIG. 5 is a perspective view of the float unit being secured within the net unit.
Figure 6:
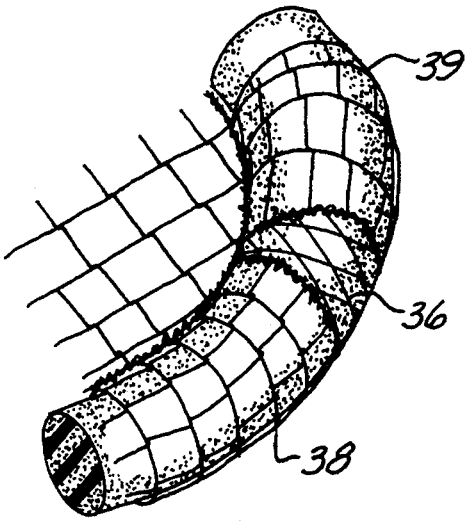
FIG. 6 is an isolated perspective view of one corner of the finished product.
Figure 7:
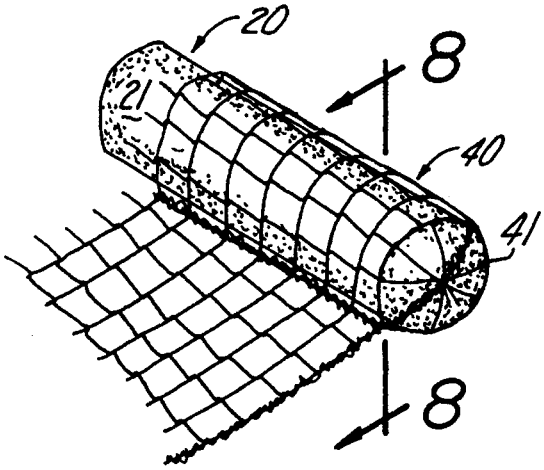
FIG. 7 is an isolated perspective view of one arm of the finished product.
Figure 8:
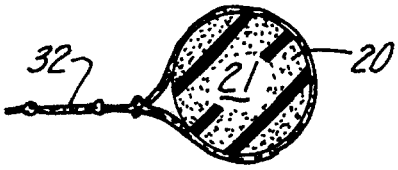
FIG. 8 is a cross-sectional view taken through line 8—8 of FIG. 7.

Turning now to FIGS. 5 and 7, it can be seen that in the fabrication of the pool float (10) one end of the netting sleeve which is designated generally as (40), is closed as at (41) such as by stitching or the like. Then, the flotation member (20) is threaded through the sleeve (40) through the open end of the sleeve (40) until the distal end of the flotation member (20) contacts the closed end of the sleeve (40). At this juncture the open end of the sleeve (40) is closed, as by stitching or the like, to complete the fabrication of the pool float (10).

As we mentioned previously in the specification, the pool float (10) of this invention is adapted to receive both conventional accessories (100), such as handle equipped drink holders (101) as well as customized accessories (not shown) which can engage and/or be suspended from the interstices of the netting.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A method for fabricating a pool float from a generally rectangular sheet of netting and an elongated generally cylindrical flotation member comprising the steps of:

a) severing two adjacent corners of the sheet of netting to form three generally rectangular panels of netting on three sides of the sheet of netting, b) folding and joining the three panels of netting to the sheet of netting to form three sleeve segments that are dimensioned to receive said flotation member; and c) threading the flotation member through the three sleeve segments to deform the flotation member into a generally U-shape.

2. The method as in claim 1 further, including the steps of:

d) closing the ends of two of the three sleeve segments to captively engage the ends of said flotation member.

3. The method as in claim 1 further including the step of:

e) forming two generally triangular-shaped flaps intermediate said rectangular panels.

4. The method as in claim 3, further including the step of:

f) joining the triangular flaps to the rectangular panels to form a contiguous sleeve that is dimensioned to surround the flotation member.

5. The method as in claim 4, further including the step of:

g) closing the ends of the contiguous sleeve to completely envelope the flotation member.

* * * * *